US007095428B2

(12) United States Patent
Harrison

(10) Patent No.: US 7,095,428 B2
(45) Date of Patent: Aug. 22, 2006

(54) SYSTEMS AND METHODS FOR MARKING LADDERS USING SUBLIMATION HEAT TRANSFER

(75) Inventor: Michael Charles Harrison, Murfreesboro, TN (US)

(73) Assignee: Louisville Ladder Group, LLC, Louisville, KY (US)

( * ) Notice: Subject to any disclaimer, the term of this patent is extended or adjusted under 35 U.S.C. 154(b) by 519 days.

(21) Appl. No.: 10/659,235

(22) Filed: Sep. 9, 2003

(65) Prior Publication Data

US 2005/0065029 A1 Mar. 24, 2005

(51) Int. Cl.
*B41J 2/315* (2006.01)

(52) U.S. Cl. ..... 347/171

(58) Field of Classification Search ..... 347/171–176, 347/99, 100, 213; 400/120.01, 120.02, 120.03, 400/120.04; 101/490, 491; 156/240, 583.1; 182/18, 129, 230

See application file for complete search history.

(56) References Cited

U.S. PATENT DOCUMENTS

| | | | | |
|---|---|---|---|---|
| 5,971,102 | A * | 10/1999 | Brown | 182/129 |
| 6,300,279 | B1 | 10/2001 | Macedo | |
| 6,364,057 | B1 * | 4/2002 | Cornejo et al. | 182/106 |
| 6,390,237 | B1 * | 5/2002 | Kim et al. | 182/161 |
| 6,516,546 | B1 * | 2/2003 | Bremick | 40/124.01 |

* cited by examiner

*Primary Examiner*—K. Feggins
(74) *Attorney, Agent, or Firm*—Egbert Law Offices

(57) ABSTRACT

Systems and methods of marking ladders. In one embodiment, a method generally includes contacting a ladder portion with an image reverse printed on a paper sheet with at least one sublimation ink, and applying heat to the paper sheet such that at least a portion of the ink sublimates from the paper sheet into the ladder portion.

18 Claims, 4 Drawing Sheets

SYSTEMS AND METHODS FOR MARKING LADDERS USING SUBLIMATION HEAT TRANSFER

FIELD

The present invention relates generally to sublimation heat transfer processes, and more particularly (but not exclusively) to systems and methods for marking ladders using sublimation heat transfer.

BACKGROUND

At construction sites, there are often times when two or more substantially identical ladders are present. To avoid confusion as to which ladder belongs to whom, many workers mark their ladder, for example, by writing their name on the ladder with a permanent ink marker.

In addition, ladder manufacturers often mark their ladders so that they are readily identified as the manufacturer of a particular ladder, thereby enabling them to capture the goodwill generated therefrom. For example, many manufacturers attach adhesive labels bearing the company's logo or trademark on the ladders they produce. However, adhesive labels can peel or fall off during the normal use of a ladder. Accordingly, there exists a need for new methods and systems for marking ladders.

SUMMARY

The present invention provides systems and methods of marking ladders. In one embodiment, a system for marking a ladder includes a printer for reverse printing an image onto a paper sheet with at least one sublimation ink. The system also includes a heat press adapted to maintain a portion of the ladder in contact with the reverse-printed image while applying heat to the paper sheet. The heat applied by the heat press causes at least a portion of the ink to sublimate from the paper sheet into the ladder portion.

In another form, the present invention provides a method for marking a ladder. In one embodiment, the method generally includes contacting a ladder portion with an image reverse printed on a paper sheet with at least one sublimation ink, and applying heat to the paper sheet such that at least a portion of the ink sublimates from the paper sheet into the ladder portion. In some embodiments, the image provided on the ladder portion can allow the ladder to readily identified. This can help safeguard the ladder by deterring theft and/or at least reduce the chance of someone mistaking ownership for and taking the ladder.

Further areas of applicability of the present invention will become apparent from the detailed description provided hereinafter. It should be understood that the detailed description and specific examples below, while indicating exemplary embodiments of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

Corresponding reference numerals indicate corresponding parts throughout the several views of the drawings.

DETAILED DESCRIPTION OF EXEMPLARY EMBODIMENTS

A method of marking a ladder according to one aspect of the present invention includes contacting a portion of a ladder with an image reverse-printed an image reverse printed on a paper sheet with at least one sublimation ink, and applying heat to the paper such that at least a portion of the ink sublimates from the paper into the ladder portion thereby providing the ladder portion with the image, but in the correct or appropriate orientation.

The image that is reverse-printed onto the paper sheet and provided on the ladder may be selected by a customer. The image can include a wide range of graphic images, designs and photographs in a wide range of colors or color combinations. By way of example, the image can include a customer's name or monogram, a traditional photograph, photographic or art prints, company logos, artwork, alphanumeric characters, advertisements, trademarks, sports team insignias, logos, distinctive marks, identifying symbols, one or more indicia, among other suitable graphic images and designs. Accordingly, embodiments of the present invention allow ladder users to customize their ladders with images of their choosing and which are durable and aesthetically appealing.

In some embodiments, the image provided on the ladder portion can allow the ladder to readily identified, for example, from a group of substantially identical ladders. This can help safeguard the ladder by deterring theft and/or at least reduce the chance that someone will mistake ownership for and take the ladder.

Figure 1:
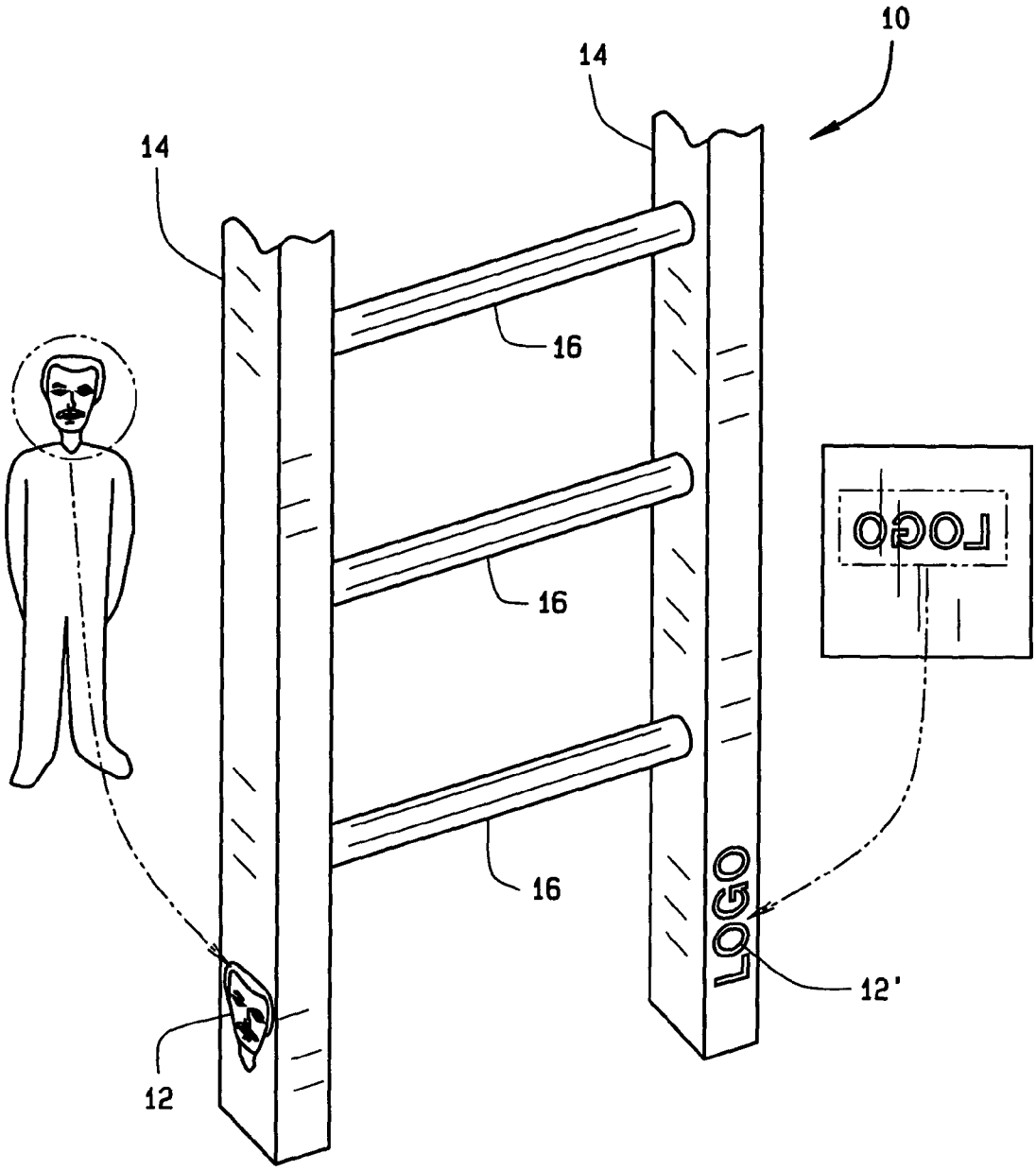
FIG. 1 is a partial perspective view of a ladder having a customer's face and a logo provided thereon in accordance with at least one embodiment of the invention.

FIG. 1 illustrates an exemplary ladder 10 having two different images 12 (e.g., an image of a person's face) and 12' (e.g., a company logo) provided on each of its side rails 14. Alternatively, or additionally, the, ladder may include images provided on other portions besides the ladder rails, such as the rungs 16. In addition, any number of (i.e., one or more) images may be provided on a ladder depending on the particular application. Consequently, the present invention should not be regarded as limited to the particular location and number of images shown and described herein.

Figure 2:
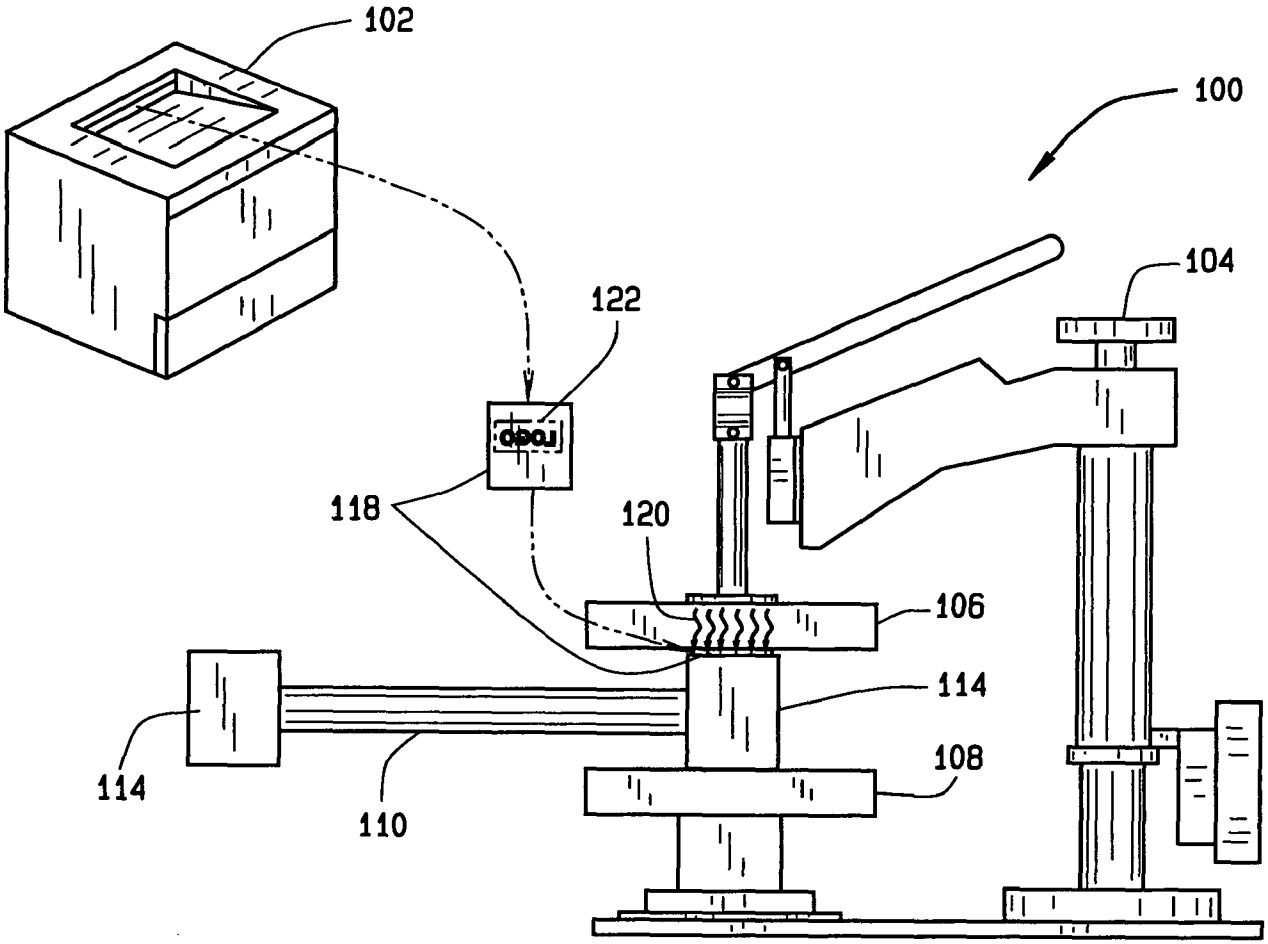
FIG. 2 is a high level diagram illustrating components of a system for marking a ladder according to one embodiment of the invention.

An exemplary system for practicing the above-described method is illustrated in FIG. 2 and indicated generally by reference character 100. As shown in FIG. 2, the system 100 includes a sublimation printer 102 which may comprise any one of a wide range of printer apparatus compatible with sublimation inks (i.e., printers having a printhead that allows sublimation inks to pass therethrough). In one embodiment, the system 100 includes a color ink jet printer capable of printing multi-colored images with sublimation inks, such as an Epson® Stylus® color ink jet printer, currently available from Epson America, Inc. of Longbeach, Calif., which is the U.S. Affiliate of Japan-based Seiko Epson Corporation.

A wide range of paper types suitable for the sublimation heat transfer process can be used in the present invention. In addition, a wide range of suitable heat sensitive sublimation inks can also be used.

The system 100 also includes a sublimation heat press 104. The heat press 104 includes an upper heat platen 106 and a lower support platen 108. The platens 106 and 108 are adapted to hold the ladder 110 and paper sheet 118 generally stationary with the paper sheet 118 on top of and in contact with the ladder rail 114. The upper heat platen 106 includes a heating element, such as a heating coil (not shown) for applying heat, indicated by arrows 120, to the paper sheet 118.

An exemplary operational sequence for the system 100 includes the printer 102 reverse printing the image 122 (e.g., LOGO) onto the paper sheet 118 with one or more sublimation inks. However, a sample image may first be printed using conventional or standard ink to allow for fine tuning and adjustments to the image before the same is reverse-printed using the sublimation inks. Once the sample image is perfected, or at least deemed satisfactory, the printer 102 then reverse prints the image 122 with the sublimation inks.

The paper sheet 118 and the ladder 110 are positioned between the upper and lower platens 106 and 108 of the heat press 104, with the reverse-printed image 122 on top and in contact with the ladder rail 114. The heat press 104 applies heat 120 to the paper sheet 118 such that at least a portion of the ink sublimates from the paper sheet 118 into the ladder rail 114.

The heat 120 applied by the heat press 104 to the paper sheet 118 causes the ink to convert directly to a gas without first becoming a liquid (i.e., sublimate). The heat also causes the pores of the material or coating (e.g., polymer, etc.) thereon to open, thus allowing the ink in gaseous form to enter the open pores.

In one embodiment, the heat press 104 heats the paper sheet 118 to a temperature between about 375 degrees Fahrenheit and 450 degrees Fahrenheit for a time interval between about one minute and about five minutes. Preferably, the heat press 104 applies heat to the paper sheet 118 at a temperature of about 420 degrees Fahrenheit for about three minutes.

At the conclusion of the heating cycle, the ladder 110 is removed from the heat press 104 and the temperature drops. As temperature drops, the pores on the ladder rail close and the ink sublimates back to solid form such that the image, previously reverse-printed the paper sheet 118, is now part of the ladder rail 114.

Figure 3:
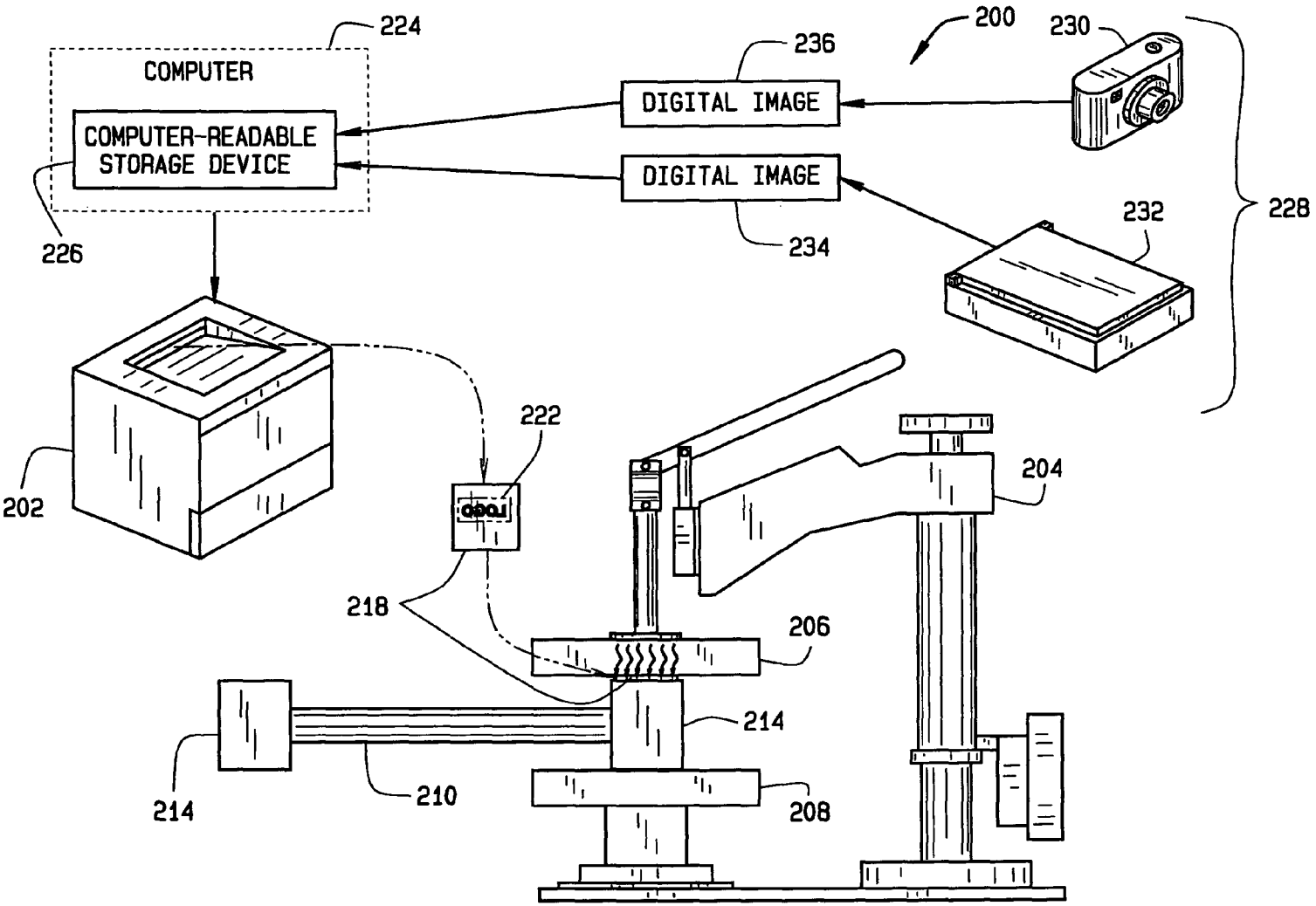
FIG. 3 is a high level diagram illustrating components of a system for marking a ladder according to another embodiment of the invention.

FIG. 3 illustrates another exemplary system 200 that can be used for marking a ladder. As shown in FIG. 3, the system 200 includes a sublimation printer 202, a sublimation heat press 204, and a computer 224 linked to the printer 202.

The computer 224 may comprise any suitable computer capable of storing data and executing software programs. The computer 224 includes a storage device 226 for storing such items as digital images, program code, software packages, programs, algorithms, information, data, files, databases, applications, among other things. The storage device 226 can be any suitable computer readable storage device, such as read only memory (ROM), random access memory (RAM), video memory (VRAM), hard disk, floppy diskette, compact disc (CD), magnetic tape, a combination thereof, etc.

The system 200 also includes one or more digital image capture devices 228 operatively associated with the computer 224. The digital image capture devices 228 may comprise any one of a wide range of digital image capture devices now known in the art or that may be developed in the future. In the illustrated embodiment of FIG. 3, the digital image capture device 228 includes a digital camera 230 and a desktop or flatbed scanner 232.

The image to be provided on the ladder rail 214 can first be created digitally. For example, a digital image 234 can be created by scanning a traditional photograph or other item (e.g., a sheet of paper containing the customer's company logo, etc.) with the desktop or flatbed scanner 232. Or for example, a digital image 236 can be acquired by using the digital camera 230 to photograph an item, such as a customer's face. In yet another example, a digital image can be created by using the computer 224 in conjunction with commercially available image editing software residing within the storage device 226.

The printer 202 reverse prints the digital image onto a sheet of sublimation paper 218 with sublimation inks. The paper sheet 218 and the ladder 210 between the upper and lower platens 206 and 208 of the heat press 204, with the reverse-printed image 222 on top and in contact with the ladder rail 214. The heat press 204 applies heat 220 to the paper sheet 218 such that at least a portion of the sublimation ink sublimates from the paper sheet 218 into the ladder rail 214. In this manner, the ladder rail 214 is provided with an image corresponding to the digital image created by the digital camera 230, scanner 232, or image editing software, as the case may be.

Figure 4:
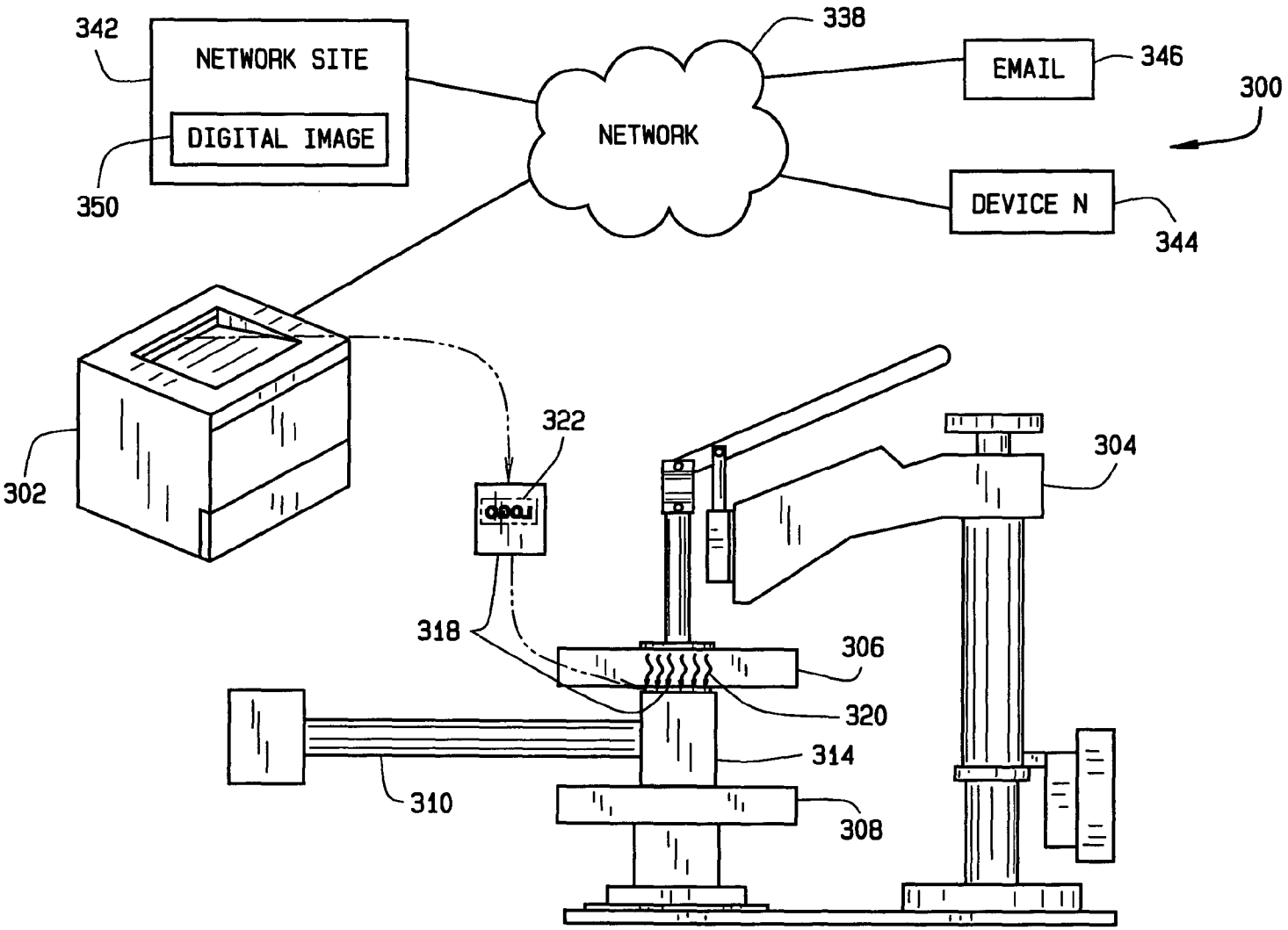
FIG. 4 is a high level diagram illustrating components of a system for marking a ladder according to another embodiment of the invention.

FIG. 4 illustrates another exemplary system 300 that includes a network 338 over which digital images can be accessed and sent to the printer 302 for printing thereby. Preferably, the network 338 comprises the Internet. However, it is to be understood that the network 338 may be any suitable network (e.g., a local area network (LAN), a wide area network (WAN), an Intranet, the Internet, a combination thereof, etc.).

Further, the network 338 may comprise any number (i.e., one or more) of network destinations and devices that are operatively associated with or linked to the network 338 (e.g., network site 342, network device 344, email server 346, digital cameras, scanners, facsimile machines, printers, a personal computers, copiers, personal digital assistants (PDAs), etc.) via any suitable means (e.g., modem, T-1, T-3, digital subscriber line (DSL), infrared, satellite, cable, etc.), including through yet other devices (e.g., routers, hubs, etc.), through yet other networks (e.g., LAN, WAN, Intranet, the Internet, etc.), etc.

During an exemplary operational sequence of the system 300, a digital image is first accessed over the network 338. For example, a digital image 350 can be retrieved from the network site 342. Or for example, a customer may provide the digital image as an attachment to an email from the email account or server 346. In either case, the printer 302 reverse prints the digital image onto a paper sheet 318.

Next, the paper sheet 318 and the ladder 310 are placed into the heat press 304 between its upper and lower platens 306 and 308, with the reverse-printed image 322 on top of and in contact with the ladder rail 314. The heat press 304 applies heat 320 to the paper sheet 318 such that at least a portion of the ink sublimates from the paper sheet 318 into the ladder rail 314. In this manner, the ladder rail 314 is provided with an image corresponding to the digital image accessed over the network 338 from the network site 342, email, etc. For example, the ladder 10 in FIG. 1 has been provided with an image 12 corresponding to a digital image of a customer's face.

It is anticipated that embodiments of the invention will be applicable to a wide range of ladders formed from various materials such as fiberglass or aluminum. Indeed, the term "ladder" as used herein refers to and includes a wide range of climbing related apparatus, such as stepping stools, hoop stools, stepladders, shelf ladders, extension ladders, library ladders, portable ladders, single ladders, warehouse ladders, among others. Accordingly, the specific references to ladder herein should not be construed as limiting the scope of the invention. Further, the present invention should also not be limited to the particular type of ladder shown in FIGS. 1 through 4.

When introducing elements or features of the present invention and the exemplary embodiments, the articles "a", "an", "the" and "said" are intended to mean that there are one or more of such elements or features. The terms "comprising", "comprise", "including", "include", "having", and "have" are intended to be inclusive and mean that there may be additional elements or features other than those specifically noted.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

What is claimed:

1. A method for marking a ladder comprising contacting a ladder portion with an image reverse printed on a paper sheet with at least one sublimation ink, and applying heat to the paper sheet such that at least a portion of the ink sublimates from the paper sheet into the ladder portion.

2. The method of claim 1, wherein the ladder portion includes a fiberglass rail of the ladder.

3. The method of claim 1, further comprising allowing a customer to select the image.

4. The method of claim 1, further comprising acquiring a digital image and reverse printing the digital image on the paper sheet with the sublimation ink such the ladder portion is provided with an image corresponding to the digital image.

5. The method of claim 4, wherein acquiring the digital image comprises digitally photographing a customer.

6. The method of claim 4, wherein acquiring the digital image comprises converting a traditional photograph to a digital image.

7. The method of claim 4, wherein acquiring the digital image comprises accessing one or more computer-readable storage media in which the digital image is stored.

8. The method of claim 4, wherein acquiring the digital image comprises acquiring the digital image over a network.

9. The method of claim 1, wherein the image comprises at least one of a photograph, a photographic print, an alphanumeric character, a logo, a distinctive mark, an identifying symbol, an advertisement, a trademark, a name, a monogram, a sports team insignia, artwork, an art print, one or more indicia, and a graphic design.

10. The method of claim 1, wherein the image provided on the ladder portion allows the ladder to be readily identified.

11. A method of safeguarding a ladder comprising contacting a ladder portion with an image reverse printed on a paper sheet with at least one sublimation ink, and applying heat to the paper sheet such that at least a portion of the ink sublimates from the paper sheet into the ladder portion to provide the ladder portion with an image that allows the ladder to be readily identified.

12. The method of claim 11, further comprising allowing a customer to select the image.

13. The method of claim 11, wherein the image resembles a customer's appearance.

14. The method of claim 11, further comprising acquiring a digital image and reverse printing the digital image on the paper sheet with the sublimation ink such the ladder portion is provided with an image corresponding to the digital image.

15. The method of claim 11, wherein the image comprises at least one of a photograph, a photographic print, an alphanumeric character, a logo, a distinctive mark, an identifying symbol, an advertisement, a trademark, a name, a monogram, a sports team insignia, artwork, an art print, one or more indicia, and a graphic design.

16. A system for marking a ladder comprising a printer for reverse printing an image onto a paper sheet with at least one sublimation ink, and a heat press adapted to hold a portion of the ladder in contact with the reverse-printed image while applying heat to the paper sheet, the heat causing at least a portion of the ink to sublimate from the paper sheet into the ladder portion.

17. The system of claim 16, wherein the ladder portion includes a fiberglass rail of the ladder.

18. The system of claim 16, further comprising a digital image capture device operatively associated with the printer to allow the printer to reverse print digital images captured by the digital image capture device.

* * * * *